US005599404A

United States Patent [19]

Alger

[11] Patent Number: 5,599,404

[45] Date of Patent: Feb. 4, 1997

[54] PROCESS FOR FORMING NITRIDE PROTECTIVE COATINGS

[76] Inventor: Donald L. Alger, 4050 Paradise Rd., Seville, Ohio 44273

[21] Appl. No.: 428,570

[22] Filed: Apr. 25, 1995

Related U.S. Application Data

[63] Continuation-in-part of Ser. No. 982,485, Nov. 27, 1992, Pat. No. 5,413,642.

[51] Int. Cl.[6] ..... C23C 8/24

[52] U.S. Cl. ..... 148/212; 148/216; 148/231; 148/238

[58] Field of Search ..... 148/206, 207, 148/212, 215, 216, 231, 238

[56] References Cited

U.S. PATENT DOCUMENTS

| | | | |
|---|---|---|---|
| 3,164,493 | 1/1965 | Lindberg | 148/6.3 |
| 3,259,526 | 7/1966 | Walker | 148/6.35 |
| 3,660,173 | 5/1972 | Matsuno et al. | 148/280 |
| 3,732,690 | 5/1973 | Meijer | 60/39 |
| 4,043,839 | 8/1977 | Hartline et al. | 148/207 |
| 4,197,707 | 4/1980 | Assno | 60/517 |
| 4,266,987 | 5/1981 | Wang | 147/280 |
| 4,312,641 | 1/1982 | Verrando et al. | 55/33 |
| 4,314,880 | 2/1982 | McGuire et al. | 376/146 |
| 4,335,884 | 6/1982 | Darche | 277/3 |
| 4,398,967 | 8/1983 | DeVan et al. | 148/6.11 |
| 4,487,637 | 12/1984 | Padamsee | 148/277 |
| 4,651,527 | 3/1987 | Alger | 60/517 |
| 4,765,847 | 8/1988 | Arai et al. | 148/15.5 |
| 4,929,287 | 5/1990 | Hirbod | 148/285 |
| 5,096,508 | 3/1992 | Breedis et al. | 148/13.2 |
| 5,294,586 | 3/1994 | Sigler | 148/285 |
| 5,372,655 | 12/1994 | Preisser et al. | 148/238 |

FOREIGN PATENT DOCUMENTS

| | | | |
|---|---|---|---|
| 145283 | 12/1980 | Germany | 148/207 |
| 2031955 | 4/1980 | United Kingdom | 148/239 |
| 2075556 | 11/1981 | United Kingdom | 148/285 |

OTHER PUBLICATIONS

Metallurgical Thermochemistry, Kubaschewski, et al, pp. 1–26, 131–137, Pergamon Press.

"Metal–Metal Oxide–Hydrogen Atmosphere Chart for Brazing or Bright Metal Processing", Supplement to the Welding Research Journal, May 1970, pp. 189–192.

Wade–Evans, G., Dissertation "Improvement of the Oxidation Wear Resistance of Steels by Means of Ion Implantation", presented 1979, pp. 1–3, 30–45.

*Metals Handbook*, 9th ed., V. 13, pp. 56–76, ASM International, 1987.

"Influence of Nonmetallic elements on the Campatibility of Structural Materials With Liquid Alkali Metals", Natesan, Journal of Nuclear Materials, 115 (1983) 251–262.

"Original HCI Surface Treatment For Diffusion Bonding of Nickel Superalloy Specimens", Billard, et al., Metals Technology (Sep. 1978) pp. 309–319.

(List continued on next page.)

*Primary Examiner*—George Wyszomierski

*Attorney, Agent, or Firm*—Fay, Sharpe, Beall, Fagan, Minnich & McKee

[57] ABSTRACT

A substrate material to be coated with either a nitride, carbide, or oxide contains a small percent of a specific reactive element, like titanium, which forms very stable nitrides, carbides, or oxides. The material also contains larger percentages of elements, such as chromium, which form less-stable nitrides, carbides, or oxides. When the substrate material is immersed in a process medium which contains reactants, such as nitrogen, carbon, or oxygen, at a chosen elevated temperature and concentration, the less-stable nitrides, carbides, or oxides are reduced and cannot form a coating on the material surface. Thus, only a very stable nitride, carbide, or oxide can form a strong, adherent coating. As such, a stable compound forms on the surface, the surface concentration of the specific reactive element atoms (example: titanium) is depleted in relation to the atom concentration in the bulk material, and a concentration gradient results which causes more of the specific reactive element atoms to diffuse to the surface and react with the reactant in the process medium until a coating of the desired thickness is formed.

7 Claims, 8 Drawing Sheets

OTHER PUBLICATIONS

"The Influence of Sulfur on Adherence of $Al_2O_3$ Grown on Fe–Cr–Al Alloys", Sigler, Oxidation of Metals, vol. 29, Nos. 1/2, 1988 pp. 23–43.

"A Relationship Between Indigenous Impurity Elements and Protective Oxide Scale Adherence Characteristics", Smeggil, et al., Metallurgical Transactions A, vol. 17A, Jun. 1986, pp. 923–932.

"Reactive Element–Sulfur Interaction and Oxide Scale Adherence", Funkenbusch, et al., Metallurgical Transactions A, vol. 16A, Jun. 1985, pp. 1164–1166.

"Oxide Scale Adhesion and Impurity Segregation at the Scale/Metal Interface" Hou, et al., Oxidation of Metals, vol. 38, Nos. 5/6, 1992 pp. 323–345.

"Adherent $Al_2O_3$ Scales Formed on Undoped NiCrAl Alloys", Smialek, Metallurgical Transactions A, vol. 18A, Jan. 1987 pp. 164–167.

"The Oxidation Behavior of CoCrAl Systems Containing Active Element Additions", Allam, et al., Oxidation of Metals, Vo. 12, No. 1 (1978) pp. 35–66.

"VIII Improvement in Properties: Additives in Oxidation Resistance", Whittle, et al., Phil. Trans. R. Soc. Lond. A 295, 309–329 (1980).

"Corrosion in Alkali Metal/Molybdenum Heat Pipes", Lundberg, et al., AIAA'84, AIAA 19th Thermophysics Converence, Jun. 25–28, 1984, pp. 1–12.

"Effect of 0.1 at.% Zirconium on the Cyclic Oxidation Resistance of β–NiAl" Barrett, Oxidation of Metals, vol. 30, Nos. 5/6, 1988, pp. 361–390.

"Heat Pipe Heat Transport System for the Stirling Space Power Converter (SSPC)", Alger, NASA Contractor Report 191065, Jan. 1993,.

PROCESS FOR FORMING NITRIDE PROTECTIVE COATINGS

This application is a continuation-in-part application of U.S. Ser. No. 07/982,485, filed Nov. 27, 1992, now U.S. Pat. No. 5,413,642.

BACKGROUND OF THE INVENTION

This invention relates to an improved process for the formation of a specific reactive element barrier layer, specifically a protective nitride, carbide, or oxide coating, on a substrate material surface. These coatings are more strongly bonded to that surface than coatings formed by conventional processes.

Nitride, carbide, and oxide coatings have been commercially used as protective coatings which resist corrosion, wear, and erosion. Titanium nitride, because of its excellent tribiological properties, has attracted considerable attention and is probably the most explored and commercialized coating. After titanium nitride, titanium carbide and aluminum oxide have also found wide use.

A useful coating is only as good as the strength of the bond between the coating and the substrate material. Good adhesion is the most important prerequisite toward engineering a commercially useful coating process. For this reason, a number of nitride, carbide, and oxide coating processes have been developed, each attempting to improve the interfacial strength between the coating and the substrate material.

Nitride, carbide, and oxide coating processes in use today include Physical Vapor Deposition (PVD), Chemical Vapor Deposition (CVD), and Ion Assisted Coating (IAV), as well as a combination of these processes.

A problem with conventional coating processes is that the processes can leave contaminants in the interface layer between the coating and the substrate. These contaminants weaken the bond and cause eventual delamination of the coatings.

For example, D'Haen, J. et al. "Interface Study of Physical Vapour Deposition TiN Coatings on Plasma-Nitrided Steels" *Surface and Coatings Technology*, v 61 (1993), pp. 194–200, reported the formation of iron and chromium nitrides, which are much less stable then titanium nitride, in the interface between an applied titanium nitride coating and the metal during the deposition of a titanium nitride coating. In the present invention, substantially only highly stable, specific reactive element nitrides, carbides, or oxides, for example titanium nitride, are selectively formed on a substrate material surface. Conventional coating processes generally cannot selectively form only a stable specific reactive element nitride, carbide, or oxide coating.

Other contaminants can also drastically reduce the adherence of an applied coating. Muller, D. et al. "Measurement of the Adhesion of TiN and Aluminum Coatings by Fracture Mechanics Tests" *Thin Solid Films*, v 236 (1993), pp. 253–256, showed that critical load and fracture load, at which point a titanium nitride coating fails, decreases with an increase of oxygen content of the coating. Yet, the presence of oxygen is common in nitride and carbide coatings formed by conventional processes. For example, Baba, K. et al., "Corrosion-Resistant Titanium Nitride Coatings Formed on Stainless Steel by an Ion-Beam Assisted Deposition", *Surface and Coatings Technology*, v. 66 (1994), pp. 368–372, reported an oxygen content of about 2% in their ion-beam assisted application of titanium nitride films. Rebenne, H. et al., "Review of CVD and TiN Coatings for Wear-Resistant Applications: Deposition Processes and Performances" *Surface and Coatings Technology, v.*63 (1994) pp. 1–13, reported that after CVD process forming of a titanium nitride coating, the coating contained several atomic percent of chlorine, oxygen and hydrogen. The chlorine and hydrogen are from the $TiCl_4$ and hydrogen present in the CVD atmosphere. Wu, L. et al., *Wear of Materials*, "Triboloby, Chemistry, and Structure of Bias Sputtered TiC films on Steel Substrates"; Glaeser et al., Ed., 1977, pp. 364–371, reported that, during the application of a titanium carbide coating, there was a considerable amount of oxygen in their process atmosphere and stated that Auger analysis later revealed the presence of titanium, carbon, oxygen, and iron in the interfacial layer between the titanium carbide and the metal. Wu et al. stated that the presence of oxygen caused the formation of titanium oxide and that delamination always occurred at the titanium oxide/titanium carbide interface.

In the present invention, one process medium used to form nitrides and carbides is pure liquid lithium metal. The liquid lithium does not contain any of the contaminants mentioned above and in addition will reduce and remove all oxides present upon the surface. During the formation of an oxide coating, as well as nitrides and carbides formed in other process mediums, the liquid metal or gaseous environment used is selected to cause only the formation of stable specific reactive element oxides, which substantially excludes the formation of other contaminating compounds.

In conventional coating processes, the processes usually start with a cleaning procedure that uses ion sputtering to remove contaminated compounds, such as sulfides, etc., from the cold substrate material surface that is to be coated. However, during the coating process the substrate material is heated, usually to a temperature between 1100° F. and 2200° F. Any sulfur present in the substrate material will then diffuse from the bulk substrate material to segregate at the surface causing the formation of stable sulfides. These sulfides interfere with the application of the coating and markedly decrease the adherence of the coating.

The solution to this problem, as described in this invention, is to either remove sulfur from the bulk substrate material before forming the coating, or to add a small percentage of a strong sulfide former to the substrate material during its preparation, such as yttrium or hafnium, so that no free sulfur is available to segregate to the substrate surface. One method of initially removing sulfur from the bulk substrate material is to anneal the material in hydrogen at a high temperature, which may be of the order of 2200° F. for superalloys.

The present invention relates to a new and improved technique for forming coatings which overcomes the above-referenced problems and produces a strongly adherent nitride, carbide, or oxide coating.

SUMMARY OF THE INVENTION

The invention relates to a substrate material to be coated with either a nitride, carbide, or oxide that contains a small percent of a specific reactive element, like titanium, which forms very stable nitrides, carbides, or oxides. The material also contains larger percentages of elements, such as chromium, which form less-stable nitrides, carbides, or oxides. When the substrate material is immersed in a process medium which contains reactants, such as nitrogen, carbon, or oxygen, at a chosen elevated temperature and concentration, the less-stable nitrides, carbides, or oxides are reduced and cannot form a coating on the material surface. Thus, only a very stable nitride, carbide, or oxide can form a strong, adherent coating. As such, a stable compound forms on the surface, the surface concentration of the specific reactive element atoms (example: titanium) is depleted in relation to the atom concentration in the bulk material, and a concentration gradient results which causes more of the specific reactive element atoms to diffuse to the surface and react with the reactant in the process medium until a coating of the desired thickness is formed.

One advantage of the present invention is that it forms a coating that resists corrosion.

Another advantage of the present invention is that it forms a coating which resists wear.

Yet another advantage of the present invention is that it forms a coating which inhibits erosion.

Still another advantage of the present invention is that it forms a titanium nitride coating with low resistivity, strongly bonded on semiconductor materials, which serves as an electrical connector in integrated circuits while still functioning as a diffusion barrier.

Still another advantage of the present invention is that it forms an excellent bond coat for thick thermal barrier coatings.

Still another advantage of the present invention, especially the gold colored titanium nitride coating, is for decorative purposes for a metallic product.

Still further advantages of the present invention will become apparent to those of ordinary skill in the art upon reading and understanding the following detailed description of the preferred embodiment.

BRIEF DESCRIPTION OF THE DRAWINGS

The invention may take form in various steps and arrangements of steps and in various components and arrangements of components. The drawings are only for purposes of illustrating a preferred embodiment and are not to be construed as limiting the invention.

DETAILED DESCRIPTION OF THE INVENTION

The Substrate Material

Figure 1:
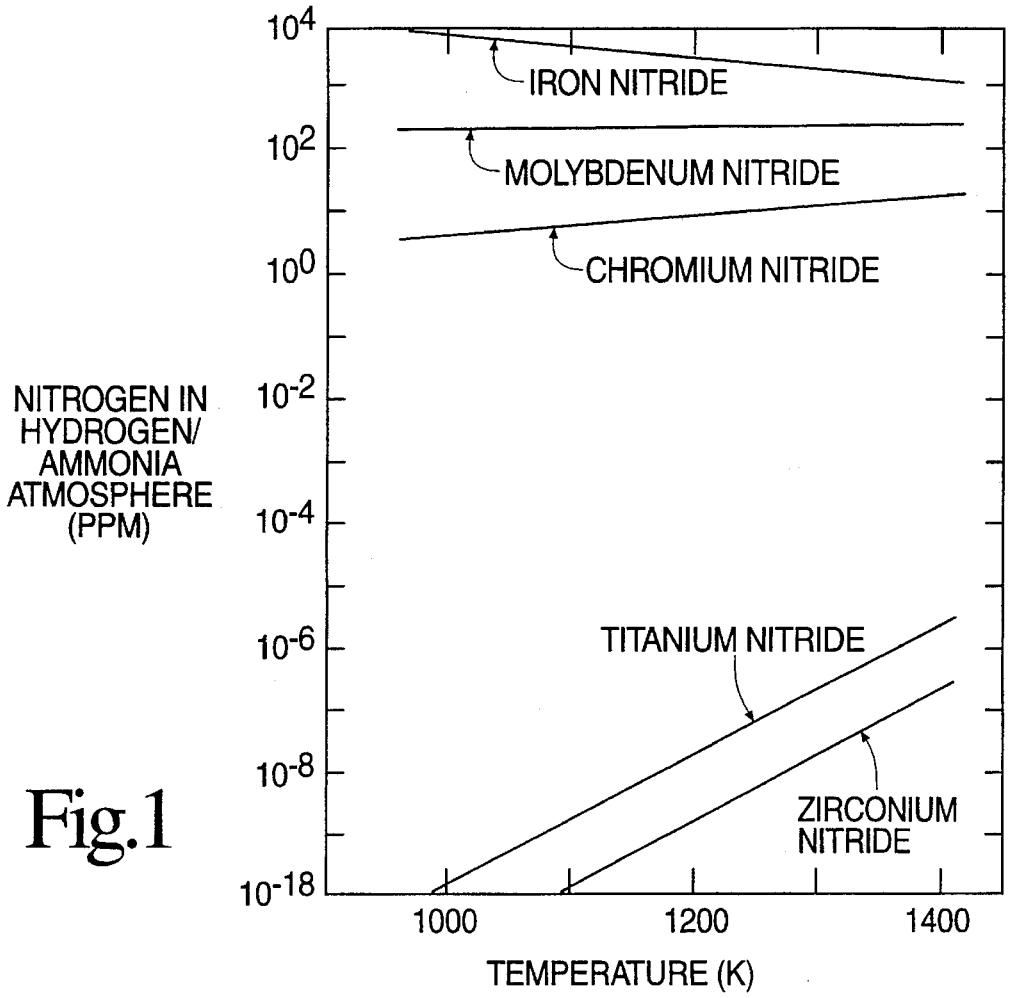
FIG. 1 illustrates the ammonia (nitrogen) concentration range over which non-specific reactive element nitrides (chromium nitride, etc.) are reduced and specific reactive element nitrides (titanium nitride, etc.) are stable.

In this invention, a gaseous or liquid metal process medium is prepared in which the substrate material is immersed. This process medium causes the selective formation of either a specific reactive element nitride, carbide, or oxide coating on the substrate material surface while preventing the formation of less stable, non-specific reactive element nitrides, carbides, or oxides. This is accomplished by utilizing the difference in thermodynamic stability, or free energy of formation, between the specific reactive elements, i.e. titanium, etc., and non-specific reactive elements, i.e. iron, etc., as a function of temperature and concentration of either nitrogen, carbon, or oxygen. The temperature of the process medium and concentration of nitrogen, carbon, or oxygen content in the process medium are chosen and controlled so that non-specific reactive elements are reduced and cannot form a nitride, carbide, or oxide.

The metal, alloy, composite, ceramic or other material, hereinafter called "substrate material" to be coated by a specific reactive element nitride, carbide, or oxide must contain a relatively low concentration of one or more thermodynamically stable, specific reactive elements selected from the group consisting of: aluminum, titanium, zirconium, tantalum, columbium, silicon, beryllium, manganese, uranium, vanadium, magnesium, thorium, calcium, barium, rare earth elements, and combinations thereof. The substrate material also usually contains relatively large percentages of less stable, non-specific reactive elements such as chromium, nickel, and iron.

Although the process media is designed to prevent the formation of most sulfides and other contaminants at the substrate surface during the nitride, carbide, or oxide formation, it is preferred that the substrate material be initially substantially free of sulfur and other contaminants. The removal of trace quantities of sulfur can be accomplished by a high temperature anneal of the substrate material in hydrogen before carrying out this coating process. Very small amounts of sulfur, less than 1 ppm, are acceptable to remain if the sulfur has been reacted with strong, stable sulfide formers like yttrium or hafnium in the bulk substrate material so that no free sulfur is available to segregate to the substrate material's surface.

Typical substrate material alloys, listed in TABLE 1, contain specific reactive elements and are free of sulfur and other contaminants.

TABLE 1

| SPECIFIC REACTIVE ELEMENT (% OF ALLOY) | | | | | |
|---|---|---|---|---|---|
| Alloy | Al | Ti | Zr | Cb &/or Ta | V |
| Incoloy 925 | 0.3 | 2.1 | | | |
| Astroloy | 4.4 | 3.5 | | | |
| IN MA-754 | 0.3 | 0.5 | | | |
| IN MA-6000E | 4.5 | 2.5 | | | |
| Hastelloy C-4 | | 0.7 | | | |
| Hastelloy N | | 0.5 | | | |
| Hastelloy S | 0.2 | | | | |
| Hastelloy X | 2.0 | | | | |
| Hastelloy C-22 | | | | | 0.35 |
| Alloy C-276 | | | | | 0.35 |
| In-100 | 5–6 | 4.5–5.0 | | | 1.0 |
| In 102 | 0.5 | 0.5 | | | 3.0 |
| In 162 | 6.5 | 1.0 | | | |
| In 738 | 3.5 | 3.5 | 0.1 | 0.6–2.0 | |
| In 617 | 1.2 | 0.3 | | | |
| In 706 | 0.4 | 1.5–2.0 | | 2.5–3.3 | |
| In 718 | 0.2–.8 | 1.0 | | 4.7–5.5 | |
| In 722 | 0.7 | 2.5 | | | |
| In X-750 | 0.7 | 2.5 | | 0.7–1.2 | |
| In 751 | 1.2 | 2.3 | | 0.7–1/2 | |
| 713C | 6.1 | 0.8 | 0.1 | 2.0 | |
| 901 | 0.2 | 2.8 | | | |
| Nimonic 75 | 0.15 | 0.4 | | | |
| Nimonic 80A | 1.4 | 2.25 | | | |
| Nimonic 90 | 1.4 | 2.4 | | | |
| Nimonic 95 | 2.0 | 2.9 | | | |
| Nimonic 100 | 5.0 | 1.5 | | | |
| Nimonic 105 | 4.7 | 1.2 | | | |
| Nimonic 115 | 5.0 | 4.0 | | | |
| Nimonic 263 | 0.45 | 2.1 | | | |
| Pyromet 860 | 1.0 | 3.0 | | | |
| B-1900 | 6.0 | 1.0 | | 4.0 | |
| D-979 | 1.0 | 3.0 | | | |
| MAR-M-004 | 5.9 | 1.0 | | | |
| MAR-M-200 | 5.0 | 2.0 | | | |
| DS MAR-M-200 | 5.0 | 2.0 | | | |
| MAR-M-246 | 5.5 | 1.5 | | | |
| MAR-M-247 | 5.5 | 1.0 | | | |
| MAR-M-421 | 4.3 | 1.7 | | | |
| MP-159 | 0.2 | 3.0 | | | |
| Udimet 500 | 2.8 | 2.8 | | | |
| Udimet 700 | 4.0 | 3.5 | | | |
| Udimet 710 | 2.5 | 5.0 | | | |
| Udimet 720 | 2.5 | 5.0 | | | |
| Unitemp AF2-1DA | 4.6 | 3.0 | | | |
| Waspaloy | 1.3 | 3.0 | | | |
| Nicrotung | 4.0 | 4.0 | | | |
| Rene-41 | 1.5 | 3.2 | | | |
| Rene-80 | 3.0 | 5.0 | | | |
| Rene-95 | 3.5 | 2.5 | | | |
| Rene-100 | 5.5 | 4.2 | | | |
| GMR-235-D | 3.5 | 4.2 | | | |
| Hastelloy S | 0.2 | | | | |
| Refractory 26 | 0.2 | 2.6 | | | |
| 19-9L | | 0.3 | | | |
| Discoloy | 0.35 | 1.7 | | | |
| A-286 | 0.2 | 2.2 | | | |
| V-57 | 0.25 | 3.0 | | | |
| Incoloy 800 | 0.38 | 0.38 | | | |
| Incoloy 801 | | 1.13 | | | |
| Incoloy 802 | 0.58 | 0.75 | | | |
| Incoloy 901 | | 2.7 | | | |
| Incoloy 903 | 0.7 | 1.4 | | 3.0 | |
| Incoloy 907 | 0.03 | 1.5 | | | |
| Incoloy 909 | 0.03 | 1.5 | | | |
| Incoloy MA 956 | 4.5 | 0.5 | | | |
| Steels: | | | | | |
| H-11 | | | | | 1.4 |
| 9Ni-4Co | | | | | 0.1 |
| 18-Ni Maraging | | 0.22 | | | |
| 302-M | | | | | 0.08 |
| 4330,Vmod | | | | | 0.07 |
| Stainless W | 0.4 | 1.2 | | | |
| 17.7 PH | 1.0 | | | | |

TABLE 1-continued

| SPECIFIC REACTIVE ELEMENT (% OF ALLOY) | | | | | |
|---|---|---|---|---|---|
| Alloy | Al | Ti | Zr | Cb &/or Ta | V |
| PH 15-7Mo | 1.0 | | | | |
| 17-14 CuMo | | 0.25 | | 0.45 | |
| AM-362 | | 0.8 | | | |
| AM-363 | | 0.5 | | | |
| PH 13-8Mo | 1.2 | | | | |
| PH 14-8Mo | 1.1 | | | | |
| 16-6 PH | 0.35 | 0.40 | | | |
| Custom 455 | | 1.2 | | | |
| 405 SS | 0.2 | | | | |
| MF-1 SS | | 0.5 | | | |
| MF-2 SS | 1.0 | 0.6 | | | |
| Uniloy 326 | | 0.2 | | | |
| 18SR | 2.0 | 0.4 | | | |
| Nitronic | | | | 0.2 | 0.2 |
| Nivco | 0.22 | 1.8 | 1.1 | | |
| MAR-M-302 | | | 0.2 | | |
| MAR-M-322 | | 0.75 | 2.3 | 4.5 | |
| MAR-M-509 | | 0.2 | 0.5 | 3.5 | |
| S-816 | | | | 4.0 | |
| V-36 | | | | 2.3 | |
| J-1570 | | 4.0 | | | |
| J-1650 | | 3.8 | | 2.0 | |
| Ti-6A1-4V | 5.68 | 89.8 | | | 4.13 |
| Ti-8A1-4V | 7.51 | 88.0 | | | 4.11 |
| Ti-6A1-2V | 5.68 | 91.8 | | | 2.10 |
| Ti-4A1-6V | 3.69 | 89.8 | | | 6.10 |
| Ti-6A1-4V-5Zr | 5.63 | 84.4 | 5.34 | | 4.15 |
| Ti-6A1-2Nb-1Ta | 6.2 | 90.3 | | 0.9 | |

For the purpose of carrying out the processes of this invention, specific reactive elements must be present as minor components of the substrate material, either in the bulk of the substrate material or in the near-surface regions which includes substrate material to a depth of approximately 100 micrometers. The specific reactive elements may be present as part of the components of a standard alloy, or a standard alloy or other material may be modified during its preparation and melt to cause the presence in the bulk substrate material of the one or more specific reactive elements needed to form the desired nitride, carbide, or oxide surface.

Therefore, in accordance with one aspect of the invention, during the preparation and melt of the substrate material, appropriate amounts of one or more specific reactive elements may be added to the bulk substrate material.

Alternatively, and in accordance with another aspect of the invention, before the step of placing the substrate material in the process medium, specific reactive element atoms may be added to the material by at least one of physically coating the material surface by mechanical, electrical, magnetic, or thermal methods, or by chemical deposition, electrical deposition, sputtering, or ion plating; and by then diffusing atoms of the coated layer into the bulk material by heating the material to a temperature between about 1000° F. and 2000° F. in a vacuum or high purity inert gas atmosphere for a sufficient time to cause the diffusion of atoms of the added surface layer into the bulk material to a depth up to about 100 micrometers. Alternatively, atoms of a specific reactive element may be added to the bulk material directly beneath the surface by ion implantation.

If undesirable specific reactive elements are already present in the bulk of the substrate material before the process is begun, they can be removed from the near-surface region of the substrate material to a depth of approximately 100 micrometers. This is done before the step of diffusing and/or implanting atoms of a specific reactive element beneath the material surface. The removal is accomplished by using a prior-art process which exposes the material for about 30 minutes or more to a hydrogen/hydrogen chloride atmosphere, consisting of about 70% hydrogen and 30% hydrogen chloride, at an elevated temperature between 1000° F. and 2000° F., causing the diffusion of specific reactive elements to the surface with the subsequent formation of gaseous chlorides, such as titanium chloride, which are exhausted into the atmosphere and away from the material. Of course, appropriate specific reactive elements may then be added to the substrate material as discussed previously.

The Process Media

Several different process media can be used to carry out the coating processes of this invention in which the substrate material is immersed for the formation of either a nitride, carbide, or oxide coating. The process media will be discussed in detail in the Preferred Embodiment section. A general coating process is described in the next section that is applicable with all process media. In that description, "gaseous reactants" refers to the presence of either nitrogen, carbon, or oxygen in the process medium which then reacts with specific reactive element atoms on the surface of the substrate material to form specific reactive element nitride, carbide, or oxide coatings.

The General Coating Process Description

A substrate material surface and contiguous regions of the substrate material are placed in contact with a static or flowing process medium at a temperature preferably between about 1000° F. and 2000° F. The overall concentration range of gaseous reactants for all process media ranges from about 0.01 ppm to 500 ppm. A particular process medium is monitored and controlled in a manner to maintain a set temperature and gaseous reactant concentration range such that the process medium reduces less-stable nitrides, carbides, or oxides, such as chromium nitride. The specific reactive element atoms, i.e. titanium, etc., at the substrate material surface react only with a gaseous reactant to form a specific reactive element nitride, carbide, or oxide coating. Forming of this coating causes a depletion of specific reactive element surface atoms and creates a concentration gradient between the surface and the interior of the substrate material. The substrate material is kept in contact with the process medium at the elevated temperature such that the specific reactive element atom concentration gradient causes the specific reactive atoms in the material interior to diffuse to the surface and react only with a gaseous reactant until a uniform, lateral nitride, carbide, or oxide coating is formed and strongly bonded to the surface. Less stable, non-specific reactive element nitrides, carbides, or oxides, as well as most sulfides and other contaminative compounds, cannot form and are excluded from the surface.

DETAILED DESCRIPTION OF THE PREFERRED EMBODIMENT

Formation of a Specific Reactive Element Nitride Coating

In a first embodiment, the coating is a specific reactive element nitride which can be formed in at least two different process media as described below. A substrate material which contains specific reactive elements, or a combination of such elements, is modified such that the surface of the substrate material forms a specific reactive element nitride coating that resists corrosion, wear, erosion, and serves other useful functions.

1. Process medium is a Hydrogen/Ammonia atmosphere

In accordance with one aspect of the present invention, a substrate material surface and contiguous regions of the substrate material are placed in contact with a static or flowing hydrogen/ammonia atmosphere at a temperature preferably between about 1000° F. and 2000° F. The hydrogen/ammonia atmosphere contains a preferred, but not limited to, concentration of about 0.1 ppm to about 10 ppm of ammonia. The hydrogen/ammonia atmosphere is monitored and controlled in a manner to maintain a set temperature and ammonia concentration within these ranges such that the hydrogen/ammonia atmosphere reduces less-stable nitrides. The specific reactive element atoms on or at the surface generally react only with nitrogen to form a specific reactive element nitride. Forming of the nitride causes a specific reactive element atom concentration gradient between the surface and the interior of the substrate material. The substrate material is kept in contact with the hydrogen/ammonia atmosphere at the elevated temperature such that the specific reactive element atom concentration gradient causes the specific reactive atoms in the material interior to diffuse to the surface and react substantially only with nitrogen until a uniform, lateral growth of specific reactive element nitride coating is formed and strongly bonded to the surface. Less stable, non-specific reactive element nitrides cannot form and are excluded from the surface.

As shown in FIG. 1, a concentration of less than 10 ppm of ammonia, as ammonia or nitrogen, is required to reduce the non-specific reactive element compound chromium nitride, as well as other nitrides above chromium nitride in FIG. 1.

2. Process Medium is Liquid Lithium

In accordance with another aspect of the present invention, a substrate material surface and contiguous regions of the substrate material are placed in contact with static or flowing liquid lithium at a temperature preferably between about 1000° F. and 2000° F. The liquid lithium contains a preferred, but not limited to, concentration of about 1.0 ppm to about 500 ppm of nitrogen. The liquid lithium is monitored and controlled in a manner to maintain a set temperature and lithium nitride concentration within these ranges such that the liquid lithium reduces less-stable nitrides. The specific reactive element atoms on or at the surface generally react only with nitrogen to form a specific reactive element nitride. Forming of the nitride causes a specific reactive element atom concentration gradient between the surface and the interior of the substrate material. The substrate material is kept in contact with the liquid lithium at the elevated temperature such that the specific reactive element atom concentration gradient causes the specific reactive atoms in the material interior to diffuse to the surface and react substantially only with nitrogen until a uniform, lateral growth of specific reactive element nitride coating is formed and strongly bonded to the surface. Less stable, non-specific reactive element nitrides generally cannot form and are substantially excluded from the surface.

Furthermore, liquid lithium has the ability to reduce most specific reactive oxides, i.e. titanium oxide, etc., and non-specific reactive oxides, i.e. iron, etc., at the surface to form lithium oxide which then diffuses into the liquid lithium. Nitrogen or lithium nitride are added periodically to the liquid lithium to assure a sufficient supply of nitrogen. Preferably, the liquid lithium is circulated through appropriate traps, common in the liquid metal industry, to remove the oxygen and lithium oxide that is formed by reduction of surface oxides on the substrate material. Competing contaminant reactions should be minimized by maintaining a high purity of liquid lithium. For example, lithium should not be contaminated with carbon or lithium carbide.

Figure 2:
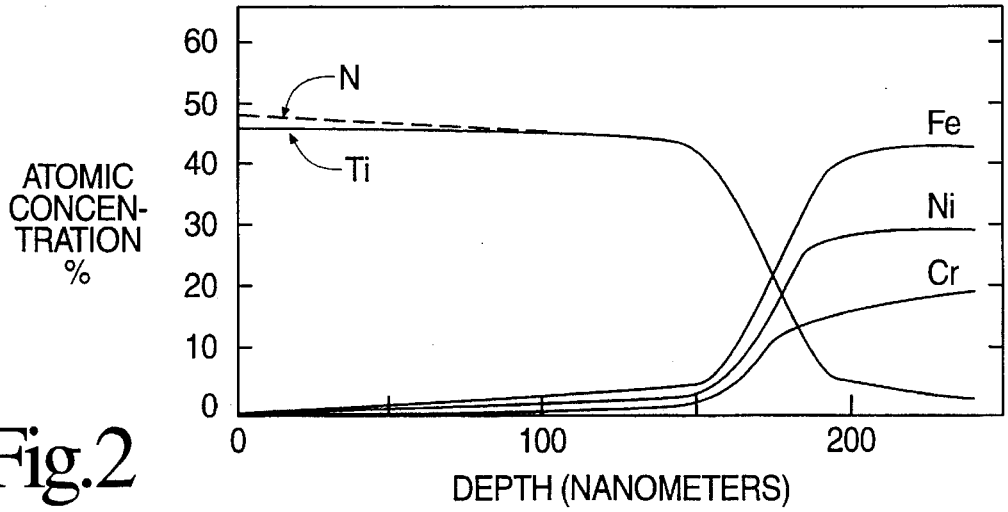
FIG. 2 illustrates atomic concentration versus depth for an Incoloy alloy after treatment in accordance with the present invention.
Figure 4:
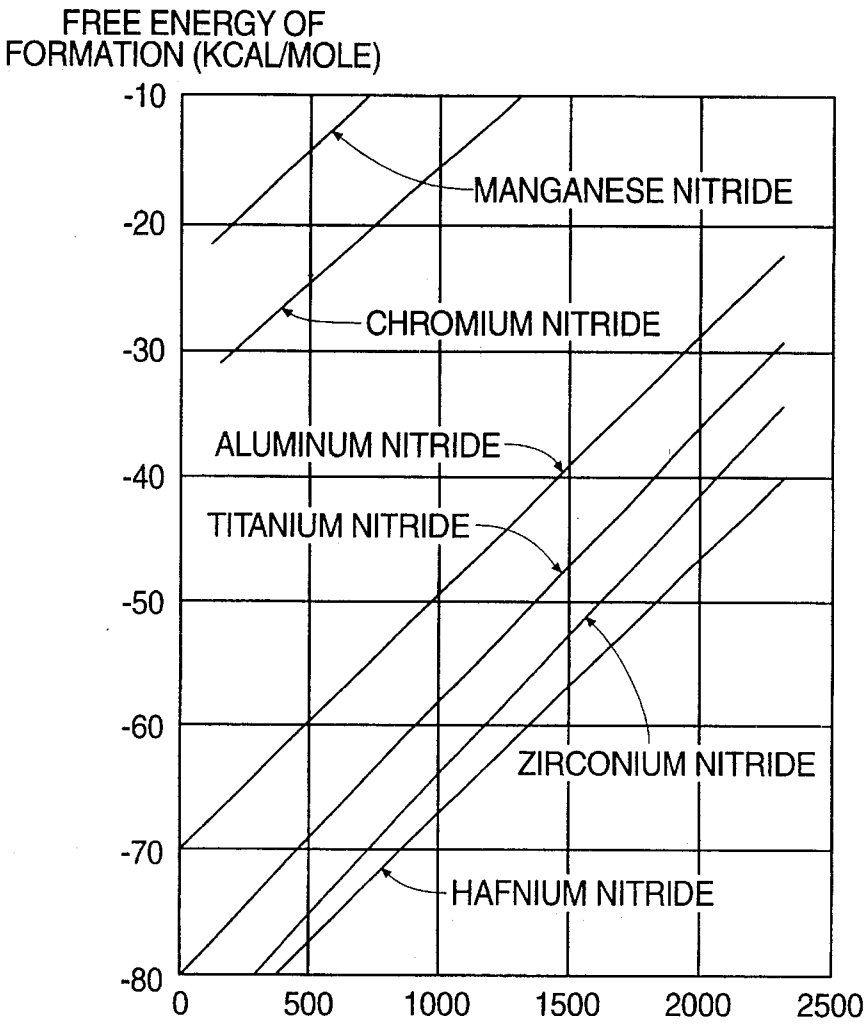
FIG. 4 illustrates a comparison of the thermodynamic stability (free energy of formation) of some specific reactive element nitrides and non-specific reactive nitrides.
Figure 3:
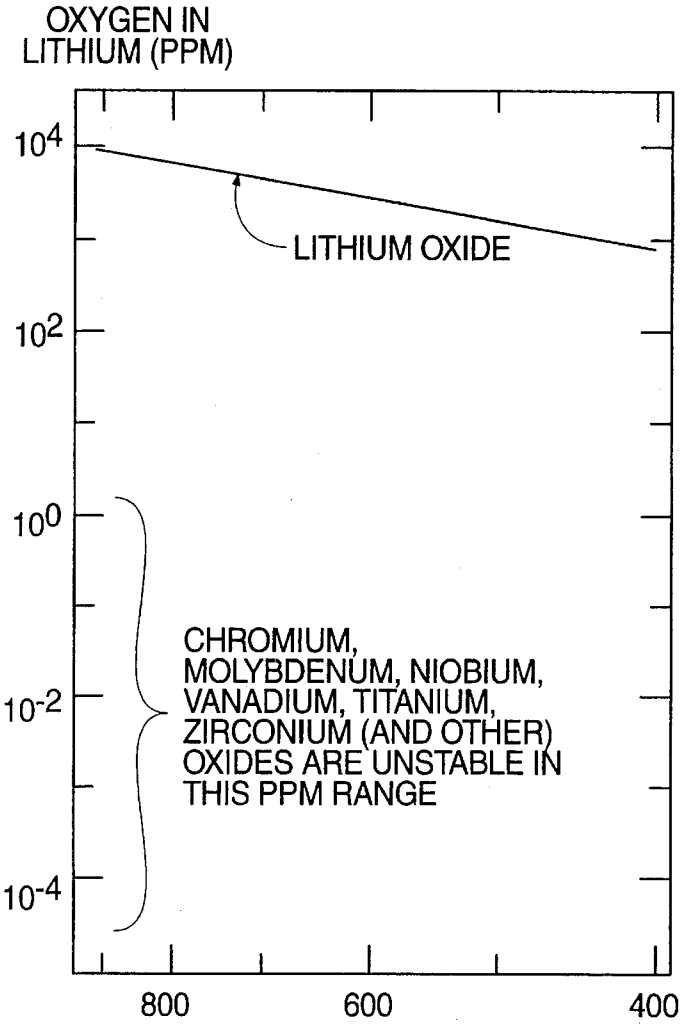
FIG. 3 shows that both specific reactive element oxides and non-specific reactive element oxides are unstable in liquid lithium.
Figure 5:
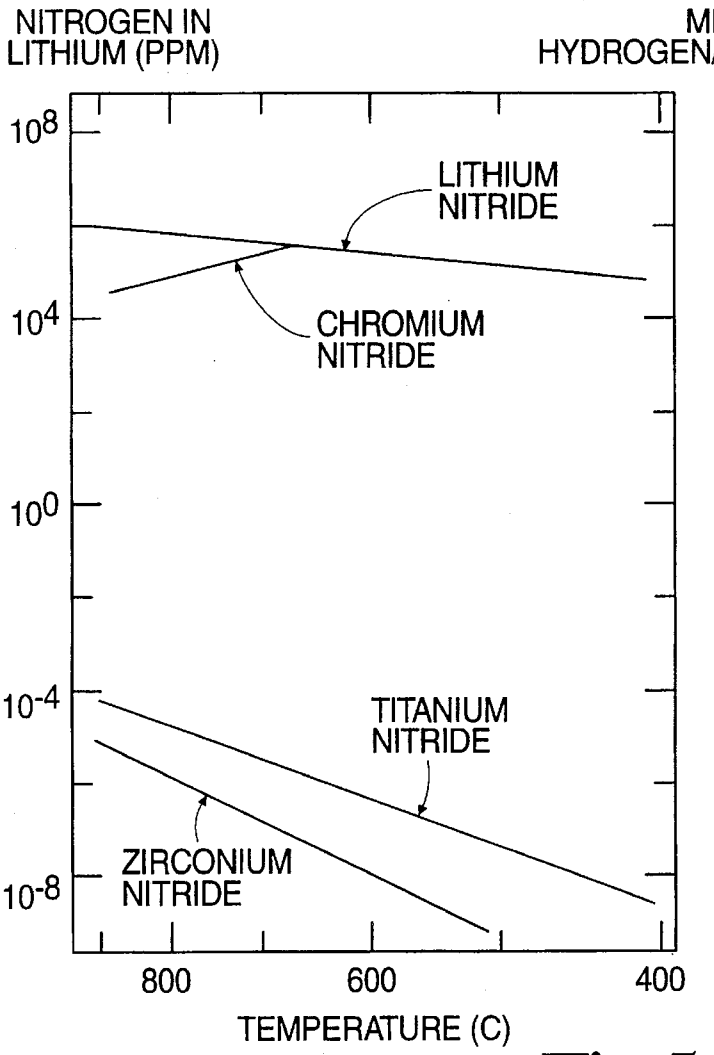
FIG. 5 illustrates that specific reactive element nitrides (titanium nitride, etc.) are stable over a wide range of nitrogen concentration in liquid lithium.

With reference to FIG. 2, a titanium nitride coating has been formed on an iron-base Incoloy 801 alloy substrate material. This alloy contains the specific reactive element titanium. The alloy was heated to an elevated temperature, preferably about 1700° F. in a process medium of flowing liquid lithium which contained a nitrogen level of about 100 ppm. As indicated by FIG. 3, all oxides are unstable in lithium so that any oxides initially present on the alloy surface are reduced with the formation of lithium oxide which diffuses into the liquid lithium. Furthermore, no more oxides will form on the alloy surface while the alloy is immersed in the liquid lithium. As shown in FIG. 4, the specific reactive element nitrides, for example, titanium nitride, are much more thermodynamically stable than non-specific element nitrides, such as chromium nitride. It is also clear, based upon the information shown in FIG. 5, why the titanium nitride compound can form on the substrate material surface in a liquid lithium process medium that contains 100 ppm of nitrogen. Other components of the Incoloy 801 alloy, such as chromium, iron and nickel cannot form nitrides on the substrate material surface.

Formation of a Specific Reactive Element Carbide Coating

In another embodiment of this invention, the coating is a specific reactive element carbide which can be formed in at least two different process media as described below. A substrate material which contains specific reactive elements, or a combination of such elements, is modified such that the surface of the substrate material forms a specific reactive element carbide coating that resists corrosion, wear, erosion, and serves other useful functions.

1. Process Medium is a Hydrogen/Methane atmosphere

In accordance with one other aspect of the present invention, a substrate material surface and contiguous regions of the substrate material are placed in contact with a static or flowing hydrogen/methane atmosphere at a temperature preferably between about 1000° F. and 2000° F. The hydrogen/methane atmosphere contains a preferred, but not limited to, concentration of about 0.01 ppm to about 10 ppm of methane. The hydrogen/methane atmosphere is monitored and controlled in a manner to maintain a set temperature and methane concentration within these ranges such that the hydrogen/methane atmosphere reduces less-stable carbides. The specific reactive element atoms on or at the surface generally react only with carbon to form a specific reactive element carbide. Forming of the carbide causes a specific reactive element atom concentration gradient between the surface and the interior of the substrate material. The substrate material is kept in contact with the hydrogen/methane atmosphere at the elevated temperature such that the specific reactive element atom concentration gradient causes the specific reactive atoms in the material interior to diffuse to the surface and react substantially only with carbon until a uniform, lateral growth of specific reactive element carbide coating is formed and strongly bonded to the surface. Less stable, non-specific reactive element carbides cannot form and are excluded from the surface.

Figure 6:
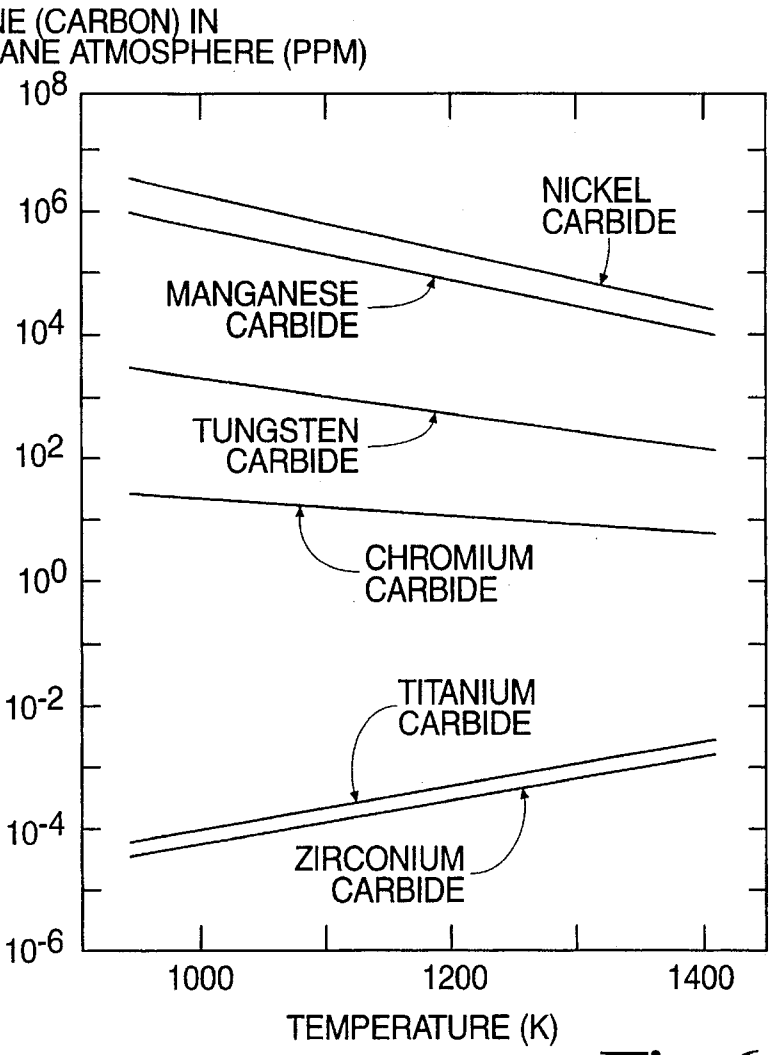
FIG. 6 illustrates the methane (carbon) concentration range over which non-specific reactive element carbides (chromium carbide, etc.) are reduced and specific reactive element carbides (titanium carbide, etc.) are stable.

As indicated in FIG. 6, a concentration of less than 10 ppm of methane, as methane or carbon, is required to reduce the non-specific reactive element compound chromium carbide, as well as other carbides above chromium on FIG. 6, thus allowing titanium carbide to form on the surface.

2. Process Medium is Liquid Lithium

In accordance with yet another aspect of the present invention, a substrate material surface and contiguous regions of the substrate material are placed in contact with static or flowing liquid lithium at a temperature preferably between about 1000° F. and 2000° F. The liquid lithium contains a preferred, but not limited to, concentration of about 1.0 ppm to about 500 ppm of lithium carbide. The liquid lithium is monitored and controlled in a manner to maintain a set temperature and lithium carbide concentration within these ranges such that the liquid lithium reduces less-stable carbides. The specific reactive element atoms on or at the surface generally react only with carbon to form a specific reactive element carbide. Forming of the carbide causes a specific reactive element atom concentration gradient between the surface and the interior of the substrate material. The substrate material is kept in contact with the liquid lithium at the elevated temperature such that the specific reactive element atom concentration gradient causes the specific reactive atoms in the material interior to diffuse to the surface and react substantially only with carbon until a uniform, lateral growth of specific reactive element carbide coating is formed and strongly bonded to the surface. Less stable, non-specific reactive element carbides cannot form and are excluded from the surface. All competing contaminant reactions should be minimized by maintaining the high purity of the liquid lithium. For example, the lithium should not be contaminated with nitrogen or lithium nitride.

Figure 7:
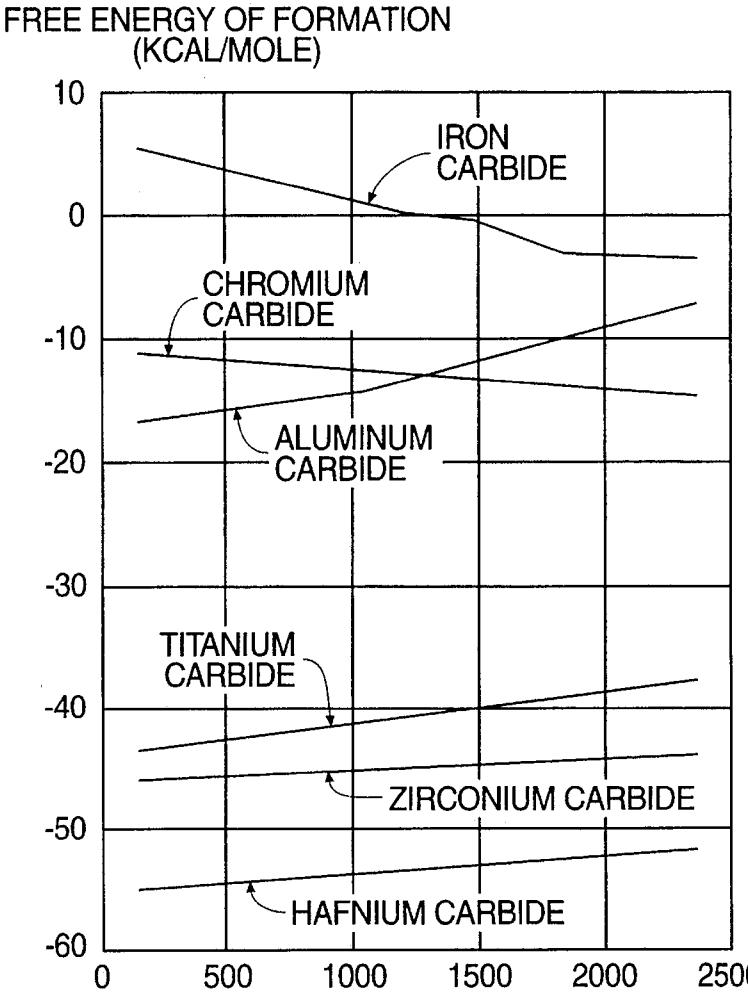
FIG. 7 illustrates a comparison of the thermodynamic stability (free energy of formation) of some specific reactive element carbides and non-specific reactive carbides.
Figure 8:
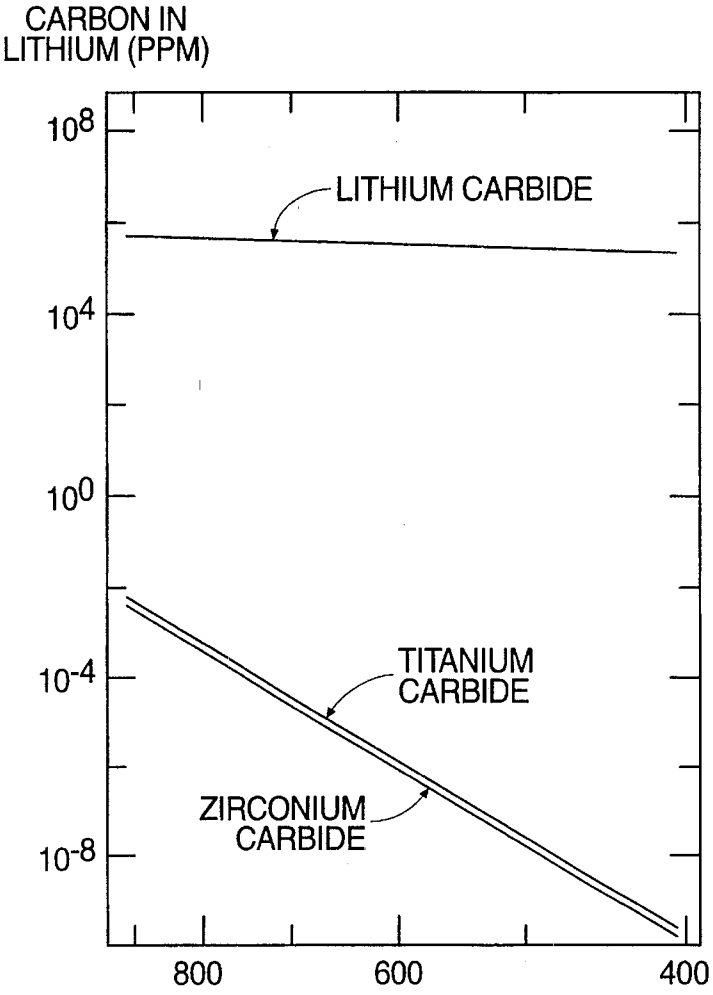
FIG. 8 illustrates that specific reactive element carbides (titanium carbide, etc.) are stable over a wide range of carbon concentration in liquid lithium.

As indicated by FIG. 3, all oxides are unstable in lithium so that any oxides initially present on a substrate material surface are reduced with the formation of lithium oxide in the liquid lithium. Furthermore, no more oxides will form on the alloy surface while the alloy is immersed in the liquid lithium. As shown in FIG. 7, the specific reactive element carbides, i.e. titanium carbide, are thermodynamically more stable than non-specific reactive element carbides, such as chromium carbide and iron carbide. It is also clear, based upon the information shown in FIG. 8, that a titanium carbide compound can easily form on a substrate material surface when about 1 ppm to 500 ppm of carbon is in the liquid lithium.

Formation of a Specific Reactive Element Oxide Coating

In yet another embodiment of this invention, the coating is a specific reactive element oxide which can be formed in at least five different process media as described below. A substrate material which contains specific reactive elements, or a combination of such elements, is modified such that the surface of the substrate material forms a specific reactive element oxide coating that resists corrosion, wear, erosion, and serves other useful functions.

1. Process Medium is Hydrogen/Water Vapor Atmosphere

In accordance with one more aspect of the present invention, a substrate material surface and contiguous regions of the substrate material are placed in contact with a static or flowing hydrogen/water vapor atmosphere at a temperature preferably between about 1000° F. and 2000° F. The hydrogen/water vapor atmosphere contains a preferred, but not limited to, concentration of about 1.0 ppm to about 500 ppm of water vapor. The hydrogen/water vapor atmosphere is monitored and controlled in a manner to maintain a set temperature and water vapor concentration within these ranges such that the hydrogen/water vapor atmosphere reduces less-stable oxides. The specific reactive element atoms on or at the surface generally react only with oxygen to form a specific reactive element oxide. Forming of the oxide causes a specific reactive element atom concentration gradient between the surface and the interior of the substrate material. The substrate material is kept in contact with the hydrogen/water vapor atmosphere at the elevated temperature such that the specific reactive element atom concentration gradient causes the specific reactive atoms in the material interior to diffuse to the surface and react substantially only with oxygen until a uniform, lateral growth of specific reactive element oxygen coating is formed and strongly bonded to the surface. Less stable, non-specific reactive element oxides cannot form and are excluded from the surface.

Figure 9:
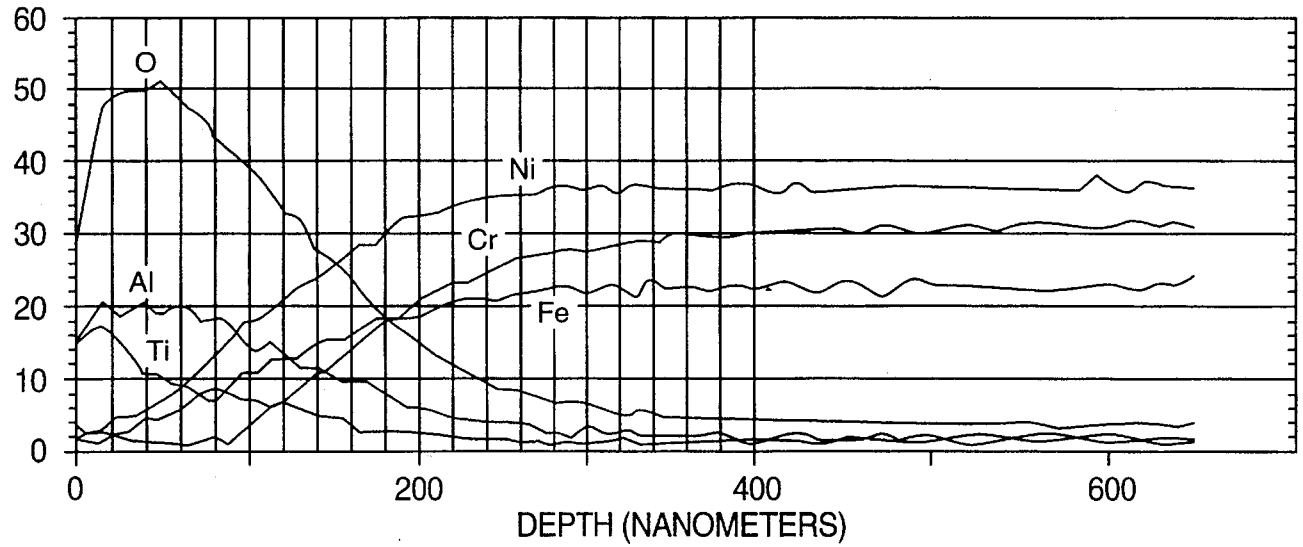
FIG. 9 illustrates atomic concentration versus depth for an Inconel 718 alloy of after treatment in accordance with the present invention.
Figure 10:
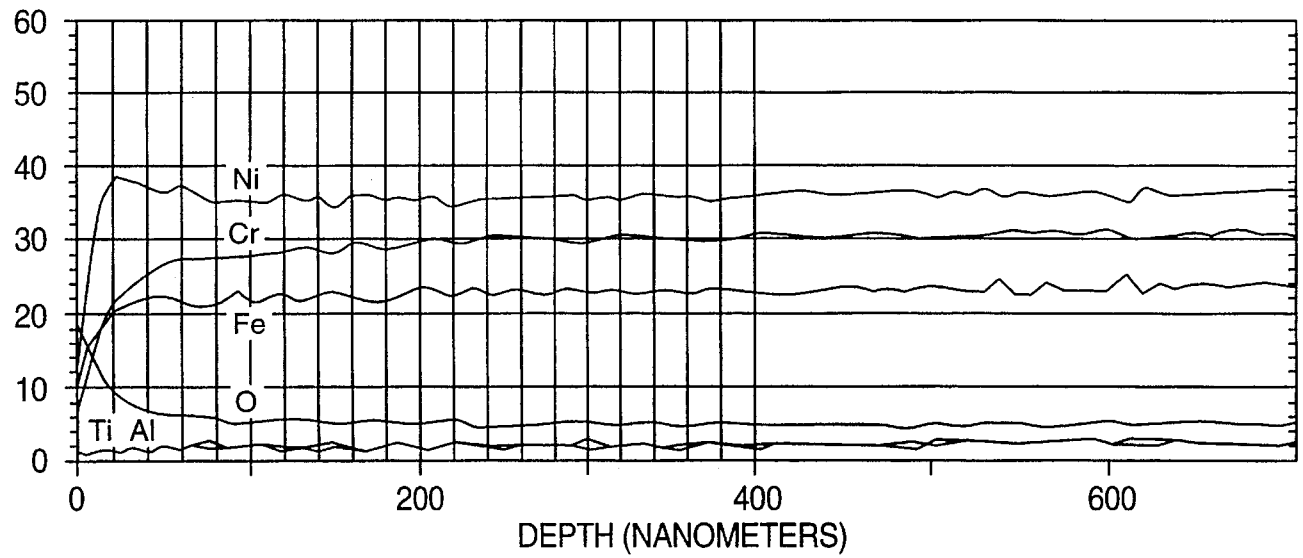
FIG. 10 illustrates atomic concentration versus depth for an Inconel 718 alloy prior to treatment in accordance with the present invention.

With reference to the Auger depth profile shown in FIG. 9, an aluminum and titanium oxide has been formed on a nickel-base Inconel alloy substrate material. The alloy contained the specific reactive elements aluminum and titanium. After processing, the entire near-surface region of the alloy has been converted to aluminum and titanium oxide. In comparison, FIG. 10 shows the Auger depth profile of an unprocessed Inconel 718 alloy which shows that the concentration of aluminum and titanium atoms near the surface is very small.

The Inconel 718 alloy was heated to an elevated temperature, preferably about 1750° F. in a flowing hydrogen/water vapor atmosphere which had a partial pressure of water vapor of about 170 ppm. This atmosphere is a reducing/oxidizing atmosphere that is generally capable of reducing all non-specific reactive element oxides on the alloy surface. Reduction of a metal oxide in a hydrogen/water vapor atmosphere occurs by the reduction reaction: metal oxide= metal+oxygen. As soon as oxygen is formed, hydrogen can react with the oxygen to form water vapor. For the reduction process to continue, at a chosen temperature, the dissociation pressure of the metal oxide must be larger than the partial pressure of water vapor. If this is not the case, the reaction is reversed and the metal surface is oxidized. A guide in selecting an appropriate balance of these parameters for a hydrogen/water vapor atmosphere is shown in prior art FIG. 11 which is from "A Metal-Metal Oxide-Hydrogen Atmosphere Chart" Bredzs and Tennenhouse Metal-Metal Oxide equilibrium curves are shown for several elements. For example, to reduce the surface iron, nickel and chromium oxides on an Inconel 718 surface at 1800° F., a partial pressure of water vapor of about $1\times10^{-1}$ torr (or a hydrogen dew point of at least −40° F.) is needed. As shown in FIG. 12, also from the Bredzs and Tennenhouse reference, this dew point corresponds to about 170 ppm of water vapor. It should be clear to anyone studying FIG. 11 that oxides, shown on the lower righthand corner of the chart, including aluminum and titanium oxides, are not reduced under these conditions.

2. Process Medium is Inert Gas/Water Vapor Atmosphere

In accordance with another aspect of the present invention, a substrate material surface and contiguous regions of the substrate material are placed in contact with a static or flowing inert gas/water vapor atmosphere at a temperature preferably between about 1000° F. and 2000° The inert gas/water vapor atmosphere contains a preferred, but not limited to, concentration of about 1.0 ppm to about 500 ppm of water vapor. The inert gas/water vapor atmosphere is monitored and controlled in a manner to maintain a set temperature and water vapor concentration within these ranges such that the inert gas/water vapor atmosphere reduces less-stable oxides. The specific reactive element atoms on or at the surface generally react only with oxygen to form a specific reactive element oxide. Forming of the oxide causes a specific reactive element atom concentration gradient between the surface and the interior of the substrate material. The substrate material is kept in contact with the inert gas/water vapor atmosphere at the elevated temperature such that the specific reactive element atom concentration gradient causes the specific reactive atoms in the material interior to diffuse to the surface and react substantially only with oxygen until a uniform, lateral growth of specific reactive element oxide coating is formed and strongly bonded to the surface. Less stable, non-specific reactive element oxides cannot form and are excluded from the surface. An inert gas such as helium or argon is used at a pressure of about 1 atmosphere with the same partial pressure of water vapor as used for the hydrogen/water vapor atmosphere. At elevated temperature, the water vapor becomes the reducing/oxidizing atmosphere. The partial pressure of water vapor and gas temperature are selected in accordance with FIG. 11 to create a reducing atmosphere which reduces the non-specific element oxides on the substrate material surface and causes the formation of specific reactive element oxides on the surface.

3. Process Medium is Vacuum/Water Vapor Atmosphere

In yet another embodiment for forming the specific reactive element oxide on a substrate material surface, the partial pressure of water vapor alone, in a vacuum environment, is the reducing/oxidizing atmosphere. In accordance with this aspect of the present invention, a substrate material surface and contiguous regions of the substrate material are placed in contact with a static or flowing vacuum/water vapor atmosphere at a temperature preferably between about 1000° F. and 2000° F. The vacuum/water vapor atmosphere contains a preferred, but not limited to, partial pressure of between about $1\times10^{-5}$ to $1\times10^{-1}$ torr of water vapor. The vacuum/water vapor atmosphere is monitored and controlled in-a manner to maintain a set temperature and water vapor concentration within these ranges such that the vacuum/water vapor atmosphere reduces less-stable oxides. The specific reactive element atoms on or at the surface generally react only with oxygen to form a specific reactive element oxide. Forming of the oxide causes a specific reactive element atom concentration gradient between the surface and the interior of the substrate material. The substrate material is kept in contact with the vacuum/water vapor atmosphere at the elevated temperature such that the specific reactive element atom concentration gradient causes the specific reactive atoms in the material interior to diffuse to the surface and react substantially only with oxygen until a uniform, lateral growth of specific reactive element oxide coating is formed and strongly bonded to the surface. Less stable, non-specific reactive element oxides cannot form and are excluded from the surface.

Figure 11:
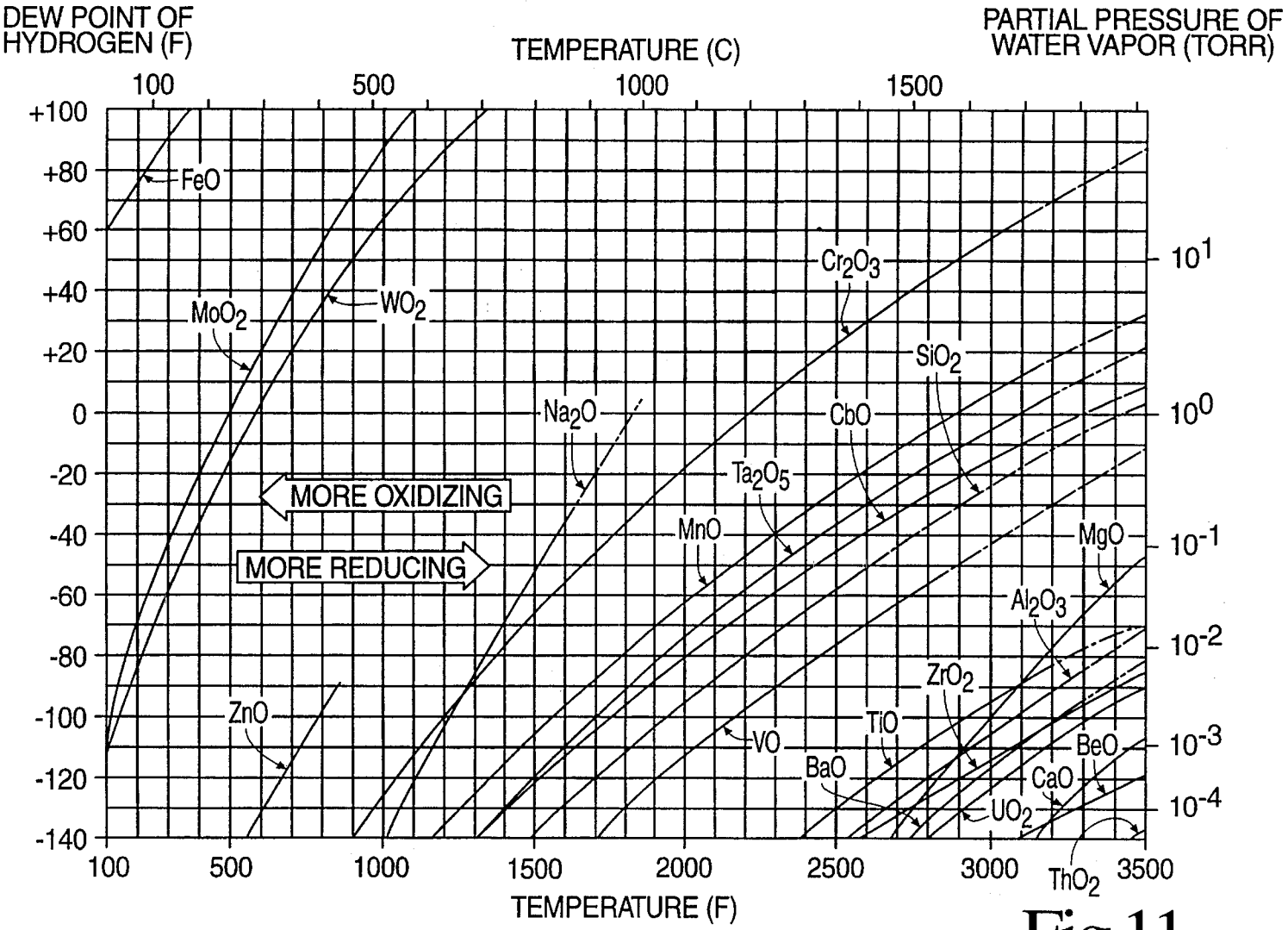
FIG. 11 is a metal-metal oxide-hydrogen atmosphere chart that graphically depicts known metal-metal oxide equilibrium curves.
Figure 12:
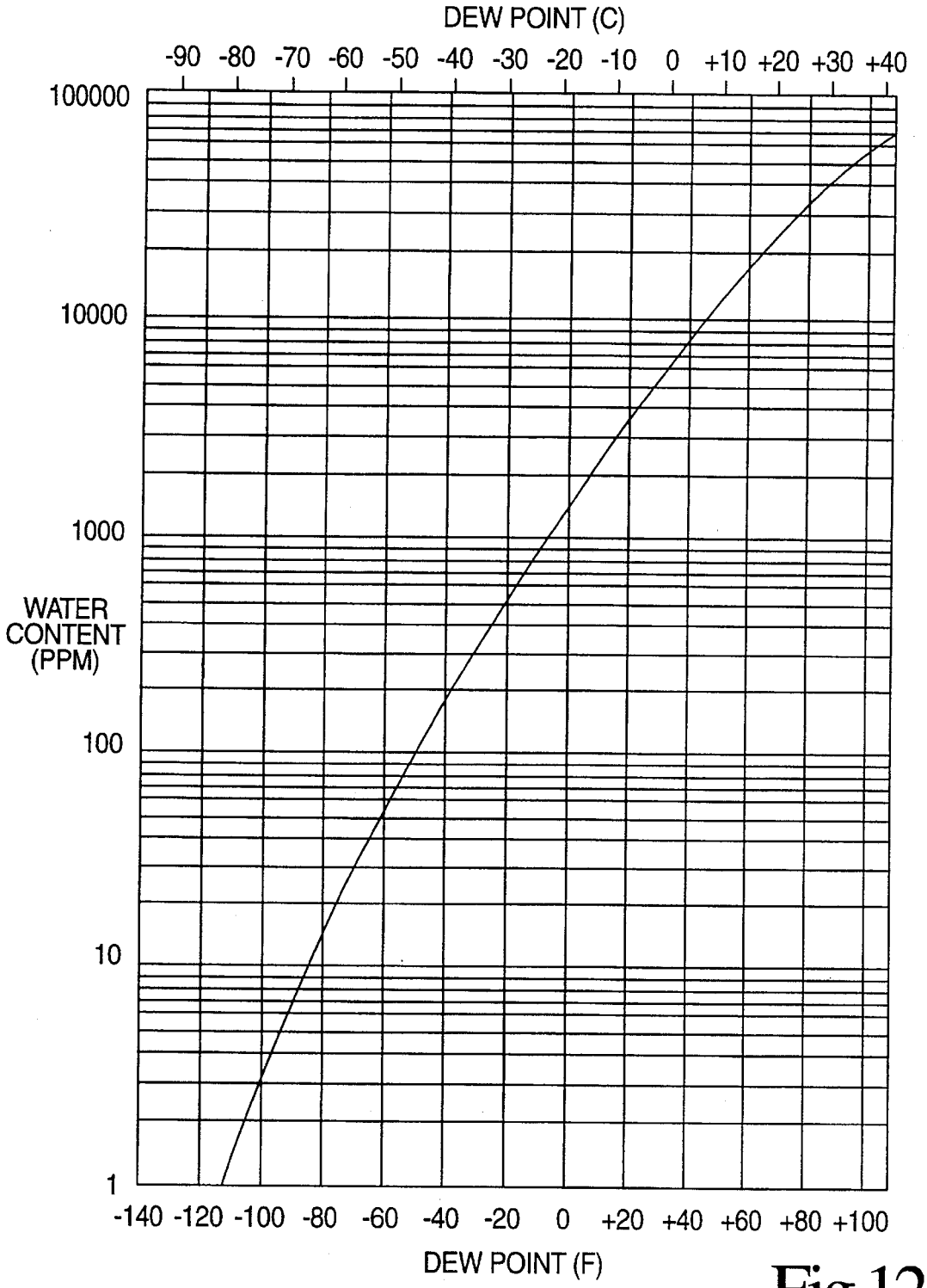
FIG. 12 is a graphic depiction of known dew point versus water content relationships.

Again, FIG. 11 is used to determine the correct temperature and partial pressure of water vapor to choose to cause the reduction of chromium, nickel, and iron oxides and allow only the aluminum and titanium oxides to be formed.

4. Process Medium is Carbon Monoxide/Carbon Dioxide Atmosphere

In accordance with another aspect of the present invention, a substrate material surface and contiguous regions of the substrate material are placed in contact with a static or flowing carbon monoxide/carbon dioxide atmosphere at a temperature preferably between about 1000° F. and 2000° F. The carbon monoxide/carbon dioxide atmosphere contains a preferred, but not limited to, concentration of about 1.0 ppm to about 500 ppm of carbon dioxide. The carbon monoxide/carbon dioxide atmosphere is monitored and controlled in a manner to maintain a set temperature and carbon dioxide concentration within these ranges such that the carbon monoxide/carbon dioxide atmosphere reduces less-stable oxides. The specific reactive element atoms on or at the surface generally react only with oxygen to form a specific reactive element oxide. Forming of the oxide causes a specific reactive element atom concentration gradient between the surface and the interior of the substrate material. The substrate material is kept in contact with the carbon monoxide/carbon dioxide atmosphere at the elevated temperature such that the specific reactive element atom concentration gradient causes the specific reactive atoms in the material interior to diffuse to the surface and react substantially only with oxygen until a uniform, lateral growth of specific reactive element oxide coating is formed and strongly bonded to the surface. Less stable, non-specific reactive element oxides cannot form and are excluded from the surface.

5. Process Medium is Liquid Metal (Other than Lithium)

In still another embodiment for forming the specific reactive element oxide coating on a substrate material surface, a liquid metal (other than lithium), such as sodium, potassium, etc. is acceptable as long as it is capable of reducing all present surface non-specific reactive element oxides (i.e., iron oxide, nickel oxide, chromium oxide, etc.) that are less stable than the specific reactive element oxides. The liquid metal reduces these less stable oxides at a lower temperature than the hydrogen/water vapor atmosphere. Liquid metal oxides are more stable than iron oxide, nickel oxide, and chromium oxide. Therefore, these surface non-specific reactive element oxides are readily reduced by the liquid metal to from liquid metal oxides.

In accordance with this aspect of the present invention, a substrate material surface and contiguous regions of the substrate material are placed in contact with a static or flowing liquid metal (other than lithium) at a temperature preferably between about 1000° F. and 2000 ° F. The liquid metal (other than lithium) contains a preferred, but not limited to, concentration of about 1.0 ppm to about 500 ppm of liquid metal oxide. The liquid metal is monitored and controlled in a manner to maintain a set temperature and liquid metal oxide concentration within these ranges such that the liquid metal reduces less-stable oxides. The specific reactive element atoms on or at the surface generally react substantially only with oxygen to form a specific reactive element oxide. Forming of the oxide causes a specific reactive element atom concentration gradient between the surface and the interior of the substrate material. The substrate material is kept in contact with the liquid metal at the elevated temperature such that the specific reactive element atom concentration gradient causes the specific reactive atoms in the material interior to diffuse to the surface and react substantially only with oxygen until a uniform, lateral growth of specific reactive element oxide coating is formed and strongly bonded to the surface. Less stable, non-specific reactive element oxides cannot form and are excluded from the surface.

Figure 13:
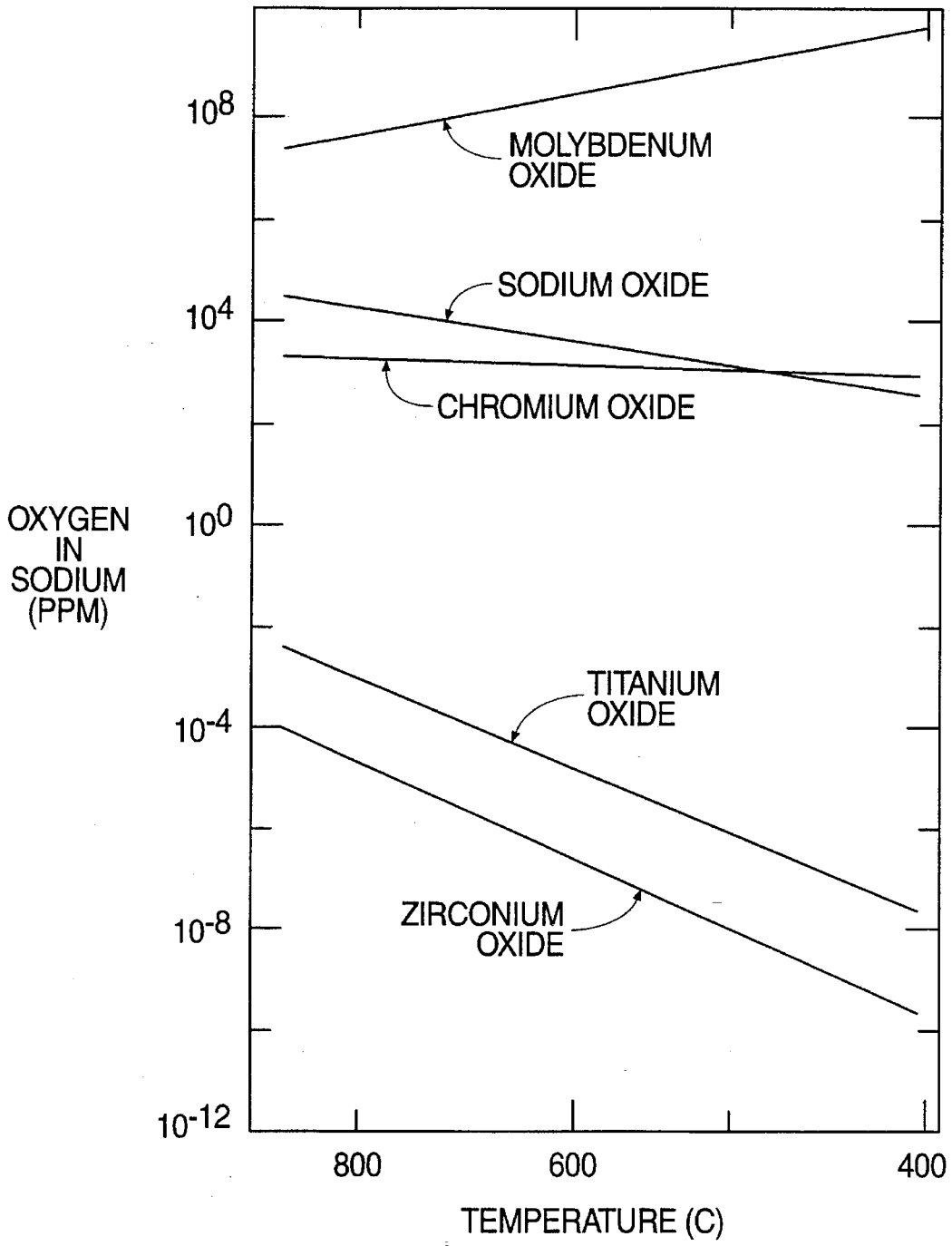
FIG. 13 illustrates the oxygen concentration range over which non-specific reactive element oxides (chromium oxide, etc.) are reduced and specific reactive element oxides (titanium oxide, etc.) are stable.

As indicated in FIG. 13 for liquid sodium, if the liquid sodium contains a preferred, but not limited to, concentration of from 1 to 500 ppm of oxygen or liquid metal oxide, chromium oxide and oxides above chromium are reduced, but a stable specific reactive element oxide coating such as titanium oxide coating is formed on a substrate material surface.

Process Medium Containers

With reference to the preferred embodiments, the material of the process medium containers, especially the internal surface of the containers in which the substrate material is placed for formation of the oxide, nitride, or carbide coating, may require special selection and/or preparation. The internal surface of the containers should be as inert as possible toward the liquid metal or gaseous atmosphere it contains. For example, if the liquid metal is sodium, molybdenum would be a good container choice since minimal reaction occurs between sodium and molybdenum. An alternative method is to use the same material for the process container as the substrate material of the part being processed. For example, if an oxide coating is being formed, the container is processed first to create an oxide coating on the internal surface. Standard state-of-the-art cleaning, degreasing and vacuum bakeout procedures, which are used in the liquid metal and vacuum industry, are applicable in preparation of the process container and substrate material surfaces prior to initiating the process. Gases and liquid metals used in the described processes are considered to be pure, without contaminants. The final criteria in determining the degree of surface cleaning necessary or the purity of gas and liquid metal needed is whether the cleanliness and purity is good enough to carry out the processes described without interference from contaminants. In a pilot program to tailor a coating process for a specific application, it is probable that ultra-clean surfaces and ultra-pure gases and liquid metals will first be used. As the specific application is defined, lower cost approaches can be used as long as an effective coating is still formed.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A method of forming a specific reactive element barrier layer on a surface of a substrate material, said substrate material being essentially free of free sulfur and other contaminants capable of segregating to said substrate material surface, and further containing specific reactive elements selected from the group consisting of aluminum, titanium, zirconium, tantalum, columbium, silicon, beryllium, manganese, uranium, vanadium, magnesium, thorium, calcium, barium, rare earth elements, and combinations thereof, and elements whose nitrides are less stable than a corresponding nitride of the specified element said method comprising the formation of a nitride barrier layer wherein said barrier layer is formed by:

a) placing at least the surface and contiguous region of said substrate material in contact with a static or flowing process medium at a temperature from about 1000° F. to about 2000° F. and containing a specified process medium nitrogen concentration;

b) monitoring and controlling the temperature and concentration of said process medium to maintain the same within the specified ranges;

c) reducing said less stable atom nitrides at the substrate surface and reacting said specific reactive element atom at said substrate surface, said reaction occurring only with said nitrogen provided by said process medium to form a specific reactive element, such formation causing a specific reactive element atom concentration gradient between the surface and interior of said substrate material; and d) continuing to maintain said substrate material surface in contact with said process medium within said specific temperature range such that said specific reactive element concentration gradient causes said specific reactive atoms in the substrate material interior to diffuse to the surface of said substrate material, where they react with the nitrogen provided by said process medium until a uniform, lateral growth of specific reactive element barrier layer is formed, said barrier layer being strongly bonded to said substrate material surface, wherein said process medium is selected from the group consisting of:

1) a hydrogen/ammonia atmosphere having a nitrogen concentration from about 0.01 ppm to about 10 ppm; and 2) liquid lithium having a lithium nitride concentration from about 1 ppm to about 500 ppm.

2. The method set forth in claim 1 further comprising, prior to carrying out said method, adding appropriate amounts of one or more of said specific reactive elements to a mixture of components of an initial material which does not contain said specific reactive elements, and forming said substrate material.

3. The method set forth in claim 1 further including, before the step of placing said substrate material into said process medium, adding atoms of said specific reactive element to said substrate material by at least one of physically coating said substrate material surface by mechanical, electrical, magnetic, or thermal methods, or by chemical deposition, electrical deposition, sputtering, or ion plating; and then by diffusing atoms of the coated layer into the bulk substrate material by heating said material to a temperature between 1000° F. and 2000° F. in a vacuum or high-purity inert gas atmosphere for a sufficient time to cause the diffusion of atoms of the applied surface layer into said substrate material to a depth of about 100 micrometers.

4. The method set forth in claim 3 further including, before the step of diffusing atoms of a specific reactive element beneath said substrate surface, and before the step of placing said substrate material into the process medium first removing any specific reactive elements from the near-surface layer of the bulk substrate material up to a thickness of approximately 100 micrometers, by exposing said substrate material for about 30 minutes to a flowing hydrogen/hydrogen chloride atmosphere, at an elevated temperature between about 1000° F. and 2000° F., causing the diffusion of said specific reactive elements to said surface with the subsequent formation of gaseous chlorides and exhausting the gaseous chlorides into a flowing atmosphere and away from said material.

5. The method set forth in claim 1 further including, adding specific reactive element atoms to said substrate material beneath said substrate surface by ion implantation prior to placing said substrate material into said process medium.

6. A method of forming a specific reactive element barrier layer on a surface of a substrate material, said substrate material being essentially free of free sulfur and other contaminants capable of segregating to said substrate material surface, and further containing specific reactive elements selected from the group consisting of aluminum, titanium, zirconium, tantalum, columbium, silicon, beryllium, manganese, uranium, vanadium, magnesium, thorium, calcium, barium, rare earth elements, and combinations thereof, and elements whose nitrides are less stable than a corresponding nitride of the specified element, said method comprising the formation of a nitride barrier layer wherein said barrier layer is formed by:

a) removing any specific reactive elements from the near-surface layer of the bulk substrate material up to a thickness of approximately 100 micrometers, by exposing said substrate material for about 30 minutes to a flowing hydrogen/hydrogen chloride atmosphere, at an elevated temperature between about 1000° F. and 2000° F., causing the diffusion of said specific reactive elements to said surface with the subsequent formation of gaseous chlorides and exhausting the gaseous chlorides into a flowing atmosphere and away from said material;

b) adding specific reactive element atoms to said substrate material beneath said substrate surface;

c) placing at least the surface and contiguous region of said substrate material in contact with a static or flowing process medium at a temperature from about 1000° F. to about 2000° F. and containing a specified process medium nitrogen concentration;

d) monitoring and controlling the temperature and concentration of said process medium to maintain the same within the specified ranges;

e) reducing said less stable atom nitrides at the substrate surface and reacting said specific reactive element atom at said substrate surface, said reaction occurring only with said provided by said process medium to form a specific reactive element nitride, such formation causing a specific reactive element atom concentration gradient between the surface and interior of said substrate material; and f) continuing to maintain said substrate material surface in contact with said process medium within said specific temperature range such that said specific reactive element concentration gradient causes said specific reactive atoms in the substrate material interior to diffuse to the surface of said substrate material, where they react with the nitrogen provided by said process medium until a uniform, lateral growth of specific reactive element barrier layer is formed, said barrier layer being strongly bonded to said substrate material surface, wherein said process medium is selected from the group consisting of:

1) a hydrogen/ammonia atmosphere having a nitrogen concentration from about 0.01 ppm to about 10 ppm; and 2) liquid lithium having a lithium nitride concentration from about 1 ppm to about 500 ppm.

7. A method of forming a specific reactive element barrier layer on a surface of a substrate material, said substrate material being essentially free of free sulfur and other contaminants capable of segregating to said substrate material surface, and further containing specific reactive elements selected from the group consisting of aluminum, titanium, zirconium, tantalum, columbium, silicon, beryllium, manganese, uranium, vanadium, magnesium, thorium, calcium, barium, rare earth elements, and combinations thereof, and elements whose nitrides are less stable than a corresponding nitride of the specified element, said method comprising the formation of a nitride barrier layer wherein said barrier layer is formed by:

a) removing any specific reactive elements from the near-surface layer of the bulk substrate material up to a thickness of approximately 100 micrometers, by exposing said substrate material for about 30 minutes to a flowing hydrogen/hydrogen chloride atmosphere, at an elevated temperature between about 1000° F. and 2000° F., causing the diffusion of said specific reactive elements to said surface with the subsequent formation of gaseous chlorides and exhausting the gaseous chlorides into a flowing atmosphere and away from said material;

b) placing at least the surface and contiguous region of said substrate material in contact with a static or flowing process medium at a temperature from about 1000° F. to about 2000° F. and containing a specified process medium nitrogen concentration;

c) monitoring and controlling the temperature and concentration of said process medium to maintain the same within the specified ranges;

d) reducing said less stable atom nitrides at the substrate surface and reacting said specific reactive element atom at said substrate surface, said reaction occurring only with said nitrogen provided by said process medium to form a specific reactive element nitride, such formation causing a specific reactive element atom concentration gradient between the surface and interior of said substrate material; and e) continuing to maintain said substrate material surface in contact with said process medium within said specific temperature range such that said specific reactive element concentration gradient causes said specific reactive atoms in the substrate material interior to diffuse to the surface of said substrate material, where they react with the nitrogen provided by said process medium until a uniform, lateral growth of specific reactive element barrier layer is formed, said barrier layer being strongly bonded to said substrate material surface, wherein said process medium is selected from the group consisting of:

1) a hydrogen/ammonia atmosphere having a nitrogen concentration from about 0.01 ppm to about 10 ppm; and 2) liquid lithium having a lithium nitride concentration from about 1 ppm to about 500 ppm.

* * * * *